US005552093A

United States Patent [19]

Lee

[11] Patent Number: 5,552,093

[45] Date of Patent: Sep. 3, 1996

[54] PROCESS FOR THE REMOVAL OF A SOLID ROCKET PROPELLANT FROM A ROCKET MOTOR CASE

[76] Inventor: David E. Lee, 2755 Fountain Oak Dr., Morgan Hill, Calif. 95037

[21] Appl. No.: 361,625

[22] Filed: Jun. 5, 1989

[51] Int. Cl.[6] ..... F27B 9/04

[52] U.S. Cl. ..... 264/3.1; 149/109.6

[58] Field of Search ..... 149/109.6; 134/24, 134/168 R; 241/23; 264/3.1; 588/202

[56] References Cited

U.S. PATENT DOCUMENTS

| | | | |
|---|---|---|---|
| 3,864,094 | 2/1975 | Locketz | 44/1 G |
| 4,088,517 | 5/1978 | Sukornick et al. | 149/1 |
| 4,160,314 | 7/1979 | Fridy | 83/651.1 |
| 4,240,587 | 12/1980 | Letsch | 241/23 |
| 4,758,387 | 7/1988 | Sayles | 149/109.6 |
| 4,793,866 | 12/1988 | McIntosh | 134/24 |
| 4,854,982 | 8/1989 | Melvin et al. | 149/109.6 |

FOREIGN PATENT DOCUMENTS

| | | |
|---|---|---|
| 0152060 | 7/1985 | European Pat. Off. . |
| 2134014 | 8/1984 | United Kingdom . |

*Primary Examiner*—Donald P. Walsh
*Assistant Examiner*—Anthony R. Chi

[57] ABSTRACT

A method of reclaiming a solid rocket motor which allows the motor case to be reused. The method comprises cooling the propellant to a temperature below the Tg range of the binder, shattering the cooled propellant and removing the shattered propellant from the rocket motor case.

9 Claims, No Drawings

PROCESS FOR THE REMOVAL OF A SOLID ROCKET PROPELLANT FROM A ROCKET MOTOR CASE

CROSS REFERENCE TO RELATED APPLICATION

This application relates to commonly-assigned application Ser. No. 110,753 filed Oct. 19, 1987 entitled "Process for the Preparation of Solid Rocket Propellant and Other Solid Explosives for Thermal Disposal or Reclamation".

1. Technical Field

The field of art to which this invention pertains is solid rocket motors and more particularly methods of remanufacturing solid rocket motors.

2. Background Art

Periodically, rocket motors are remanufactured due to concern that the propellant has aged to the point where its performance could be unreliable. In addition, in the normal course of production, certain parts of the solid rocket motors will develop propellant grain defects. In most instances, propellant is so firmly bonded to the rocket motor case by means of liners and insulation interface that only peripheral hardware can be safely removed such as the rocket nozzle, electronic cabling, etc. Attempts to separate the propellant from the motor case (which is typically a metal or composite material) can result in an uncontrolled detonation. Thus, removal of the propellant, which typically has to be scrapped, can result in the destruction of an expensive composite rocket motor case.

Accordingly, there is a need in this industry for methods of remanufacturing solid rocket motors that permit the case to be salvaged.

DISCLOSURE OF THE INVENTION

This invention is directed to a method of reclaiming a solid rocket motor which allows the motor case to be reused. The method comprises cooling the propellant to a temperature below the Tg range of the binder, shattering the cooled propellant and removing the shattered propellant from the rocket motor case.

These processes make a significant advance in the field of solid rocket motors. By providing methods for the removal of solid propellant from rocket motor cases a variety of safety and cost problems are obviated.

The foregoing and other objects, features and advantages of the present invention will become apparent from the specification and claims which will illustrate an embodiment of the invention.

BEST MODE FOR CARRYING OUT THE INVENTION

Typically, propellants comprise fuel, binder (this also acts as a fuel), oxidizer, and a variety of additives. For example, aluminum, boron or beryllium are typical stabilizing fuels. Ammonium perchlorate, ammonium nitrate and potassium perchlorate are typical oxidizers. There are a variety of polymeric binders such as polybutadiene, polyesters, butadiene terpolymer and carboxyl terminated polybutadiene. Finally, additives such as iron oxide are used as burning accelerators and zirconium oxide is used to stabilize combustion.

Typically, binders are added to propellants to hold the various constituents of the mixture together and assure uniformity of the mixture. Polymeric binders are resilient material which provide overall strength to the propellant mixture. Thus, any effort to shatter, break up or crush propellant requires enough energy to overcome the compressive and tensile strength of the polymeric binder. Unfortunately, prior efforts to remove the propellant from the motor case require too much energy resulting in an unplanned and uncontrolled conflagration or detonation. In addition, as the propellant is granulated, the surface area is greatly increased resulting in considerably greater sensitivity to shock or an uncontrolled source of energy such as static electricity. The process of this invention substantially reduces the amount of energy required to overcome the polymeric binder tensile and compressive strength, reducing the probability of an unplanned conflagration or detonation during propellant removal.

According to this invention, the propellant is exposed to a medium capable of lowering the propellant's temperature to a temperature below the glass transition temperature range (Tg) range of the polymer(s) used as a binder. By Tg is meant that temperature range where the mechanical properties change as the polymer changes from a glassy brittle solid to a soft, rubbery material. Classically, Tg refers to the point where two graphed lines of temperature vs. mechanical strength for the material in its brittle and soft, rubbery state cross. In reality, this does not occur at a point but over a range which is here referred to as the Tg range.

As the polymer is cooled to a temperature below its Tg range, the polymer becomes more glassy and brittle. This causes a reduction in the amount of energy required to break the polymer into smaller pieces because the forces of attraction in the polymer chain are lessened. Exemplary temperatures are about −79° C. to about −210° C. as these are the pertinent temperatures for those mediums listed below. For propellants this results in less energy being required to shatter the propellant facilitating its removal and thus a lesser probability of an unplanned detonation during removal from the motor case.

Generally, the colder the medium, the time required to reduce the propellant's temperature is shortened and ultimately the lower the propellant temperature, the less chance of an unplanned detonation during propellant removal. Any medium that is capable of lowering the temperature of the propellant to the above-described temperature may be used. For example, liquid nitrogen, liquid nitrous oxide or dry ice are readily available materials. Liquid nitrogen is preferred as it has a sufficiently low temperature, is readily available and is inert to the propellants.

Typically, the process of this invention includes cooling the propellant containing motor case to a temperature below the Tg range of the binder, shattering the propellant by means of energy input such as mechanical impact and removing the propellant from the rocket motor case. Peripheral hardware such as the rocket nozzle, electronic cabling, igniter, thrust vector control components and attached structures are generally removed prior to the cooling process to eliminate any damage to the hardware from cold, impact, etc. and to facilitate handling of the case containing propellant. The rocket motor case and propellant may be exposed to the cooling medium by a variety of methods. For example, the propellant-containing motor case may be immersed in the cooling medium, liquid nitrogen or placed in a freezer compartment. The method of cooling used, typically depends on the dimensions of the rocket motor case, the type of propellant, and the overall mass of the system. It is preferred to use liquid nitrogen on composite motor cases containing polybutadiene-type propellant.

Once the rocket motor case and propellant are cooled, the propellant is subjected to energy impact which shatters it, causing the propellant to fall out of the case structure by gravity into an appropriate receptacle, or otherwise facilitating removal from the rocket motor case. The propellant may be shattered by a variety of means including mechanical means, such as by impact, acoustical means, such as ultrasound and other means.

Once shattered the propellant is removed from the motor case. After removal, the cryogenically treated propellant may be disposed of as is or further processed, such as granulated, for reclamation of its various components or used for providing energy to boilers and the like. Typically, if the propellant is not scrapped, it is further reduced in particle size and further processed.

Propellant components may be reclaimed by a variety of conventional chemical extraction processes such as a water leaching operation to remove the ammonium perchlorate from the propellant. Alternatively, the cryogenic crushed material can be burned in a conventional boiler and incinerator. Cleaning the resultant gases of pollutants in, for example, a scrubber system provides for safe continuous propellant disposal in a contained system where pollution can be controlled.

These processes provide a significant advance to the field of manufacture and remanufacture of solid rocket motors. By providing methods for the ingredient reclamation of solid rocket motors, propellant and cases, a variety of safety and cost problems are obviated. Specifically, this invention provides a process for the safe, efficient removal of unspent solid rocket fuel from rocket motor cases.

It should be understood that the invention is not limited to the particular embodiment shown and described herein, but that various changes and modifications may be made without departing from the spirit or scope of this concept as defined by the following claims.

I claim:

1. A method of reclaiming a solid rocket motor, said motor comprising a binder containing propellant disposed in a motor case comprising:

a) cooling the propellant to a temperature below the Tg range of the binder;

b) shattering the cooled propellant; and c) removing the shattered propellant from the rocket motor case.

2. The method as recited in claim 1 wherein the cooled propellant is shattered by exposure to sound waves.

3. The method as recited in claim 1 wherein the propellant is cooled by placing the propellant in thermal relationship to cryogenic liquid.

4. The method as recited in claim 1 wherein the propellant is cooled to a temperature of about −79° C. to about −210° C.

5. The method as recited in claim 2 wherein said cooled propellant is subject to mechanic impact.

6. The method as recited in claim 1 wherein said propellant is cooled preferentially to the case.

7. The method as recited in claim 6 wherein propellant subject to energy impact and removal in stages.

8. The method as recited in claim 6 wherein heating means are provided to the case to permit control of the differential cooling of the propellant and case.

9. The method as recited in claim 6 wherein insulating means are provided to the outside surface of the case to permit control of the differential cooling of propellant and case.

* * * * *